US006231301B1

(12) United States Patent
Barnett et al.

(10) Patent No.: US 6,231,301 B1
(45) Date of Patent: May 15, 2001

(54) CASING TREATMENT FOR A FLUID COMPRESSOR

(75) Inventors: Mark Barnett, West Hartford; Martin Graf, Norwalk, both of CT (US); John A. Raw, Burlington (CA); Om Sharma, South Windsor; William D. Sprout, Tolland, both of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/208,355

(22) Filed: Dec. 10, 1998

(51) Int. Cl.[7] ..... F01D 1/12

(52) U.S. Cl. ..... 415/57.4; 415/58.7; 415/914; 415/58.5; 415/119; 415/173.1

(58) Field of Search ..... 415/10, 1, 26, 415/36, 37, 57.3, 57.4, 58.4, 58.5, 58.7, 59.1, 92, 116, 119, 144, 914, 173.1, 57.1

(56) References Cited

U.S. PATENT DOCUMENTS

| | | | |
|---|---|---|---|
| 3,843,278 | | 10/1974 | Torell . |
| 3,901,620 | * | 8/1975 | Boyce ..... 415/1 |
| 3,934,410 | | 1/1976 | Williams . |
| 3,966,355 | | 6/1976 | Pierpoline . |
| 3,999,884 | | 12/1976 | Fuller . |
| 4,050,845 | | 9/1977 | Gemein et al. . |
| 4,086,022 | | 4/1978 | Freeman et al. . |
| 4,238,170 | | 12/1980 | Robideau et al. . |
| 4,239,452 | | 12/1980 | Roberts, Jr. . |

(List continued on next page.)

FOREIGN PATENT DOCUMENTS

| | | |
|---|---|---|
| 1357016 | 6/1974 | (GB) . |
| 2041149 | 9/1980 | (GB) . |
| 2158879 | 11/1985 | (GB) . |

OTHER PUBLICATIONS

ASME publication, 75–GT–95, "Effect of Outer Casing Treatment and Tip Clearance on Stall Margin of a Supersonic Rotating Cascade", by Jean Fabri and Jean Reboux, pp. 1–7.

ASME publication, 75–GT–13, "Study on the Mechanism of Stall Margin Improvement of Casing Treatment", by H.Takata and Y. Tsukuda, pp. 1–16.

*Primary Examiner*—Christopher Verdier
*Assistant Examiner*—Richard Woo
(74) *Attorney, Agent, or Firm*—Kenneth C. Baran

(57) ABSTRACT

An axial flow or centrifugal flow compressor having arrays of blades (16) extending across a working medium flowpath (18) includes a casing treatment for enhancing the compressor's fluid dynamic stability. In one variant of the invention the casing treatment comprises one or more circumferentially extending grooves (40) that each receive indigenous fluid from the compressor flowpath at a fluid extraction site (56) and discharge indigenous fluid into the flowpath at a fluid injection site (58), circumferentially offset from the extraction site, where the migrated fluid is better able to advance against an adverse pressure gradient in the flowpath. Each groove is oriented so that the discharged fluid enters the flowpath with a streamwise directional component that promotes efficient and reliable integration of the introduced fluid into the flowpath fluid stream (20). In a second variant of the invention, the casing treatment comprises a circumferentially extending compartment (62), typically comprising a voluminous pressure compensation chamber (64) and a single passage (66) circumferentially coextensive with the chamber, for establishing fluid communication between the chamber and the flowpath. The voluminous character of the compartment attenuates the inordinate circumferential pressure difference across the tips of excessively loaded compressor blades (16), making the compressor less susceptible to tip vortex induced instabilities. One embodiment of the pressure compensating variant includes a passage (66) oriented similarly to the groove (40) of the grooved variant of the casing treatment so that fluid flowing from the passage enters the flowpath with a streamwise directional component.

18 Claims, 10 Drawing Sheets

U.S. PATENT DOCUMENTS

| | | | | |
|---|---|---|---|---|
| 4,466,772 | | 8/1984 | Okapuu et al. . | |
| 4,540,335 | * | 9/1985 | Yamaguchi et al. | 415/129 |
| 4,708,584 | | 11/1987 | Meng . | |
| 4,714,406 | | 12/1987 | Hough . | |
| 4,781,530 | | 11/1988 | Lauterbach et al. . | |
| 4,930,978 | * | 6/1990 | Khanna et al. | 415/58.3 |
| 4,930,979 | * | 6/1990 | Fisher et al. | 415/58.4 |
| 5,137,419 | | 8/1992 | Waterman . | |
| 5,238,364 | | 8/1993 | Kreitmeier . | |
| 5,246,335 | * | 9/1993 | Mitsubori et al. | 415/914 |
| 5,282,718 | | 2/1994 | Koff et al. . | |
| 5,290,144 | | 3/1994 | Kreitmeier . | |
| 5,297,928 | | 3/1994 | Imakiire et al. . | |
| 5,308,225 | | 5/1994 | Koff et al. . | |
| 5,313,700 | | 5/1994 | Dorman . | |
| 5,327,716 | | 7/1994 | Giffin, III et al. . | |
| 5,431,533 | | 7/1995 | Hobbs . | |
| 5,474,417 | * | 12/1995 | Privett et al. | 415/58.5 |
| 5,520,508 | | 5/1996 | Khalid . | |
| 5,531,565 | | 7/1996 | Meindl et al. . | |
| 5,562,404 | * | 10/1996 | Koff et al. | 415/57.4 |
| 5,586,859 | | 12/1996 | Nolcheff . | |
| 5,607,284 | | 3/1997 | Byrne et al. . | |
| 5,707,206 | | 1/1998 | Goto et al. . | |
| 5,762,470 | | 6/1998 | Gelmedov et al. . | |

* cited by examiner

CASING TREATMENT FOR A FLUID COMPRESSOR

TECHNICAL FIELD

The present invention relates to stability enhancing casing treatments for fluid compressors, such as the compressors and fans used in turbine engines, and particularly to casing treatments that discourage development of potentially destabilizing vortices near the tips of the compressor blades.

BACKGROUND OF THE INVENTION

Centrifugal and axial flow compressors include a fluid inlet, a fluid outlet and one or more arrays of compressor blades projecting outwardly from a rotatable hub or shaft. A casing, whose inner surface defines the outer boundary of a fluid flowpath, circumscribes the blade arrays. Each compressor blade spans the flowpath so that the blade tips are proximate to the outer flowpath boundary, leaving a small clearance gap to enable rotation of the shaft and blades. During operation, the compressor pressurizes a stream of working medium fluid, impelling the fluid to flow from a relatively low pressure region at the compressor inlet to a relatively high pressure region at the compressor outlet.

Because compressors urge the working medium fluid to flow against an adverse pressure gradient (i.e. in a direction of increasing pressure) they are susceptible to stall, a localized fluid dynamic instability that locally impedes fluid flow through the compressor and by surge, a larger scale fluid dynamic instability characterized by fluid flow reversal and disgorgement of the working medium fluid out of the compressor inlet. Compressor stall and surge are obviously undesirable. If the compressor is a component of an aircraft gas turbine engine, a surge is especially unwelcome since it causes an abrupt loss of engine thrust and can damage critical engine components.

In a turbine engine, surge or stall may be provoked by any of a number of influences, among them fluid leakage through the clearance gap separating each blade tip from the compressor case. Leakage occurs because the fluid pressure adjacent the concave, or pressure surface of each blade exceeds the pressure along the convex, or suction surface of each blade. The leaking fluid interacts with the fluid flowing through the primary flowpath to form a fluid vortex. The strength of the vortex depends in part on the size of the clearance gap and on the pressure difference or loading between the suction and pressure sides of the blade. Compressors can usually tolerate vortices of limited strength. However a locally excessive clearance gap or locally excessive loading of one or more blades can generate a vortex powerful enough to seriously disrupt the progress of fluid through the flowpath, resulting in a surge or stall.

Compressor designers strive to develop compressors that are highly tolerant of potentially destabilizing influences. One way that designers enhance compressor stability is by incorporating special features, referred to as casing treatments, in the compressor case. One type of stability enhancing casing treatment is a series of circumferentially extending grooves, each substantially perpendicular to the streamwise direction (the predominant direction of fluid flow in the flowpath). U.K. Patent Application 2,158,879 depicts such a casing treatment, but does not elaborate on the physical mechanisms responsible for improving stability. It is thought that the grooves provide a means for fluid to exit the flowpath at a locale where the blade loading is severe and the local pressure is high, migrate circumferentially to a locale where the pressure is more moderate, and re-enter the flowpath. The migrated fluid is thus better positioned to contend with the adverse pressure gradient in the flowpath. Moreover, the fluid migration helps relieve the locally severe blade loading. It has also been observed that the presence of the grooves degrades compressor efficiency, presumably because fluid re-enters the flowpath in a direction substantially perpendicular to the streamwise direction, resulting in efficiency losses as the re-entering fluid collides with and mixes turbulently with the flowpath fluid stream. The re-entering fluid, lacking any appreciable streamwise directional component of its own, may also tend to recirculate unbeneficially into and out of the groove.

Another type of casing treatment is shown in U.S. Pat. No. 5,762,470 and U.K Patent Application 2,041,149. These patents disclose compressors employing a manifold to alleviate circumferential pressure nonuniformities that may be associated with destabilizing tip leakage vortices. The manifold shown in U.S. Pat. No. 5,762,470 is an annular cavity that communicates with the flowpath by way of a series of slots separated by a gridwork of ribs. U.K. Patent Application 2,041,149 discloses a centrifugal compressor having a manifold that communicates with flowpath through a set of slotted diffuser vanes. The application also discloses an axial flow compressor with a manifold radially outboard of the compressor flowpath and a manifold chamber radially inboard of the flowpath. A spanwise slot on the suction surface of each compressor blade places the compressor flowpath in fluid communication with the inboard manifold chamber. The compressor vanes include similar slots that connect the flowpath to the outboard manifold. Notwithstanding the possible merits of the disclosed arrangements, they clearly introduce a measure of undesirable manufacturing complexity into the compressor.

Still another type of casing treatment is shown in U.S. Pat. Nos. 5,282,718, 5,308,225, 5,431,533 and 5,607,284, all of which are assigned to the assignee of the present application. These patents describe variations of a turbine engine casing treatment known as vaned passage casing treatment (VPCT). The disclosed casings include a passageway occupied by a set of anti-swirl vanes. Fluid extraction and injection passages place the vaned passageway in fluid communication with the compressor flowpath. During operation, fluid with degraded axial momentum, but high tangential momentum, flows out of the flowpath by way of the extraction passage, through the vane set, and then back into the flowpath by way of the injection passage. The vane set redirects the fluid, exchanging its tangential momentum for increased axial momentum so that the injected fluid is more favorably oriented than the extracted fluid.

Despite the merits of the vaned passage casing treatment, it is not without certain drawbacks. The vaned passageway consumes an appreciable amount of space, a clear disadvantage considering the space constraints typical of aerospace applications. The treatment also presents manufacturing and fabrication challenges. Moreover, debris may clog portions of the vaned passageway, compromising the effectiveness of the treatment. Finally, the treatment degrades compressor efficiency by allowing pressurized fluid to recirculate to a region of lower pressure in the compressor flowpath. The efficiency loss may be mitigated by employing a regulated system as proposed in U.S. Pat. No. 5,431,533. However the regulated system introduces additional complexity.

Finally, U.S. Pat. No. 5,586,859, also assigned to the assignee of the present application, discloses a "flow aligned" casing treatment in which a circumferentially extending plenum communicates with the flowpath by way of discrete extraction and injection passages. The flow aligned treatment, like VPCT, recirculates pressurized fluid to a lower pressure region, introducing the fluid into the flowpath in a prescribed direction to achieve optimum performance. However the flow aligned casing treatment suffers from many of the same disadvantages as VPCT.

Notwithstanding the existence of the above described casing treatments, compressor designers continually seek improved ways to reliably enhance compressor stability and minimize any attendant efficiency loss without complicating manufacture of the compressor or its components.

SUMMARY OF THE INVENTION

According to one aspect of the present invention, a compressor casing treatment comprises one or more circumferentially extending grooves that each receive indigenous fluid from the compressor flowpath at a fluid extraction site and discharge indigenous fluid into the flowpath at a fluid injection site. Fluid extraction occurs at a site where the fluid pressure in the compressor flowpath is relatively high and the streamwise momentum of the fluid is relatively low. Fluid injection occurs at a site, circumferentially offset from the extraction site, where the flowpath fluid pressure is more modest and the streamwise momentum of the fluid is relatively high. Thus, each groove diverts fluid circumferentially to a location where the fluid is better able to advance against the flowpath adverse pressure gradient. Each groove is oriented so that the discharged fluid enters the flowpath with a streamwise directional component that promotes efficient integration of the introduced fluid into the flowpath fluid stream. The streamwise component also counteracts any tendency of the introduced fluid to recirculate locally into and out of the groove.

According to a second aspect of the invention, a compressor casing treatment comprises a circumferentially extending pressure compensation chamber and a single passage, circumferentially coextensive with the chamber, for establishing fluid communication between the chamber and the flowpath. The combined volume of the passage and the pressure compensation chamber is large enough to attenuate the inordinate circumferential pressure difference across the tip of an excessively loaded blade. By attenuating the pressure variation, the casing treatment unloads the blade tips in the immediate vicinity of the passage, making the compressor less susceptible to vortex induced instabilities. This pressure compensating variant of the invention, unlike the grooved variant described above, is thought to operate primarily by attenuating circumferential pressure variations rather than by encouraging circumferential migration of indigenous fluid. Nevertheless, some fluid will flow into and out of the passage and chamber. Therefore, one embodiment of the pressure compensating variant includes a passage oriented similarly to the groove of the grooved variant of the casing treatment so that fluid flowing from the passage enters the flowpath with a streamwise directional component.

The inventive casing treatment is advantageous in many respects. It improves compressor stability without excessively penalizing compressor efficiency. The treatment is simple, and so can be incorporated without adding appreciably to the cost of the compressor or unduly complicating its manufacture. Unlike some prior art casing treatments, the inventive treatment is relatively unlikely to become clogged by foreign objects. The treatment can operate passively, avoiding the weight, bulk, cost and complexity of a control system. The grooved variant of the treatment is space efficient, making it readily applicable to the core engine compressors of a turbine engine. The pressure compensating variant, although less space efficient, is nevertheless a viable treatment for a turbine engine fan casing where space constraints are somewhat less severe.

The foregoing aspects, features and advantages and the operation of the invention will become more apparent in light of the following description of the best mode for carrying out the invention and the accompanying drawings.

BEST MODE FOR CARRYING OUT THE INVENTION

Figure 1:
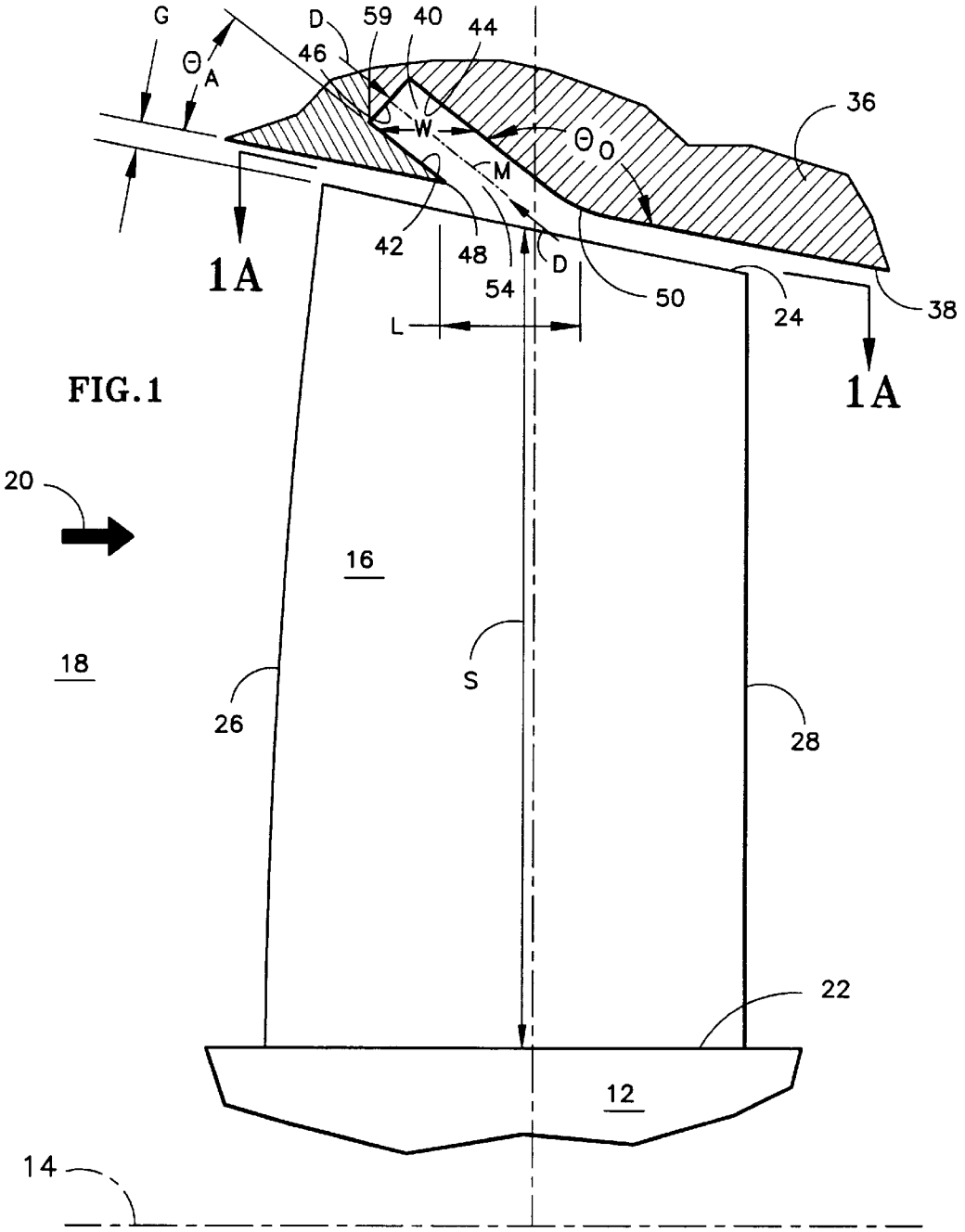
FIG. 1 is a schematic, cross sectional side view typical of an axial flow compressor or fan for a turbine engine and showing a grooved casing according to one aspect of the present invention.

FIG. 1 schematically illustrates a portion of an axial flow compressor representative of those used in turbine engines. In the context of a turbine engine the term "compressor", as used throughout this specification, refers to both the core engine compressors and to the relatively large diameter, low compression ratio fans employed on many engine models. The compressor includes a hub 12 rotatable about a compressor rotational axis 14 and an array of blades 16 extending radially outwardly from the hub. The blades 16 span a compressor flowpath 18 that extends substantially parallel to the rotational axis 14 and channels a stream of air or other working medium fluid 20 through the compressor. Each blade has a root 22, a tip 24, a leading edge 26 and a trailing edge 28.

Figure 1A:
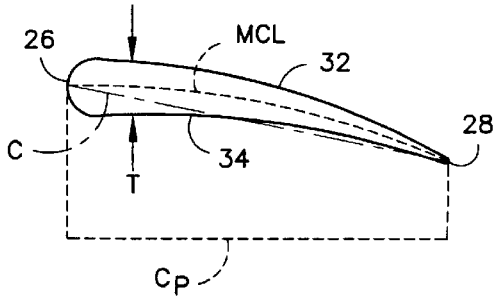
FIG. 1A is a cross-sectional view of a compressor blade taken in the direction 1A—1A of FIG. 1.

As seen best in FIG. 1A, each blade has suction and pressure surfaces 32, 34 extending from the leading edge to the trailing edge and spaced apart by an axially nonuniform blade thickness T. Each blade also has a mean camber line MCL, which is a locus midway between the pressure and suction surfaces as measured perpendicular to the mean camber line. A chord line C, which is a locus that extends linearly from the leading edge to the trailing edge, joins the ends of the mean camber line. A projected chord $C_P$, is the chord line C projected onto a plane that contains the rotational axis 14.

The compressor also includes a casing 36 having a radially inner flowpath surface 38. The flowpath surface circumscribes the blade array and is spanwisely or radially spaced from the blade tips by a small clearance gap G. The casing includes a circumferentially continuous groove 40 defined by axially spaced apart upstream and downstream walls 42, 44, each of which extends from a groove floor 46 and adjoins the flowpath surface at respective upstream and downstream lips 48, 50. The lips define a groove mouth 54 that places the groove in fluid communication exclusively with the flowpath 18. The upstream wall 42 is oriented at an acute angle $\theta_A$ relative to the flowpath surface 38 and the downstream wall 44 is oriented at an obtuse angle $\theta_O$ relative to the flowpath surface.

Figure 2B:
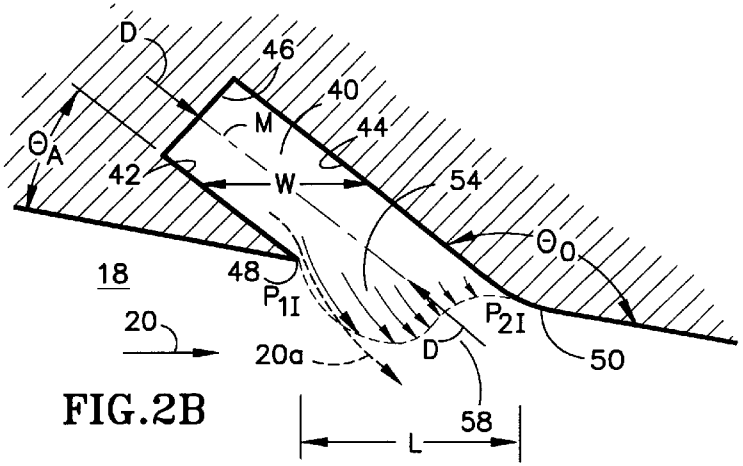
FIGS. 2A and 2B are views similar to FIG. 1 schematically illustrating the distribution of fluid flow into a casing treatment groove at an extraction site and out of the casing treatment groove at an injection site circumferentially offset from the extraction site.
Figure 2A:
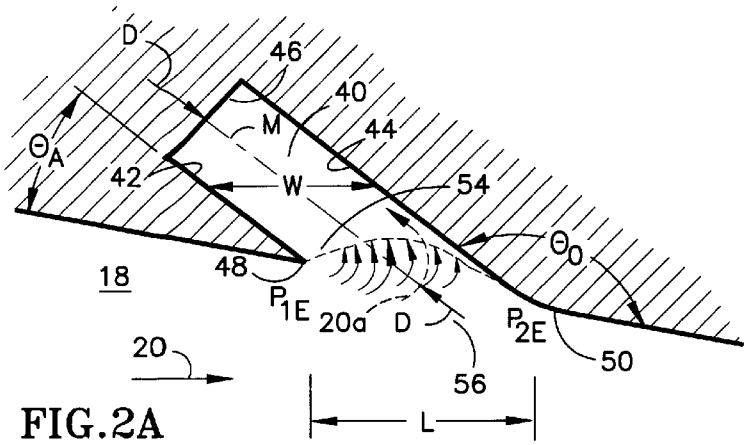
Figure 2:
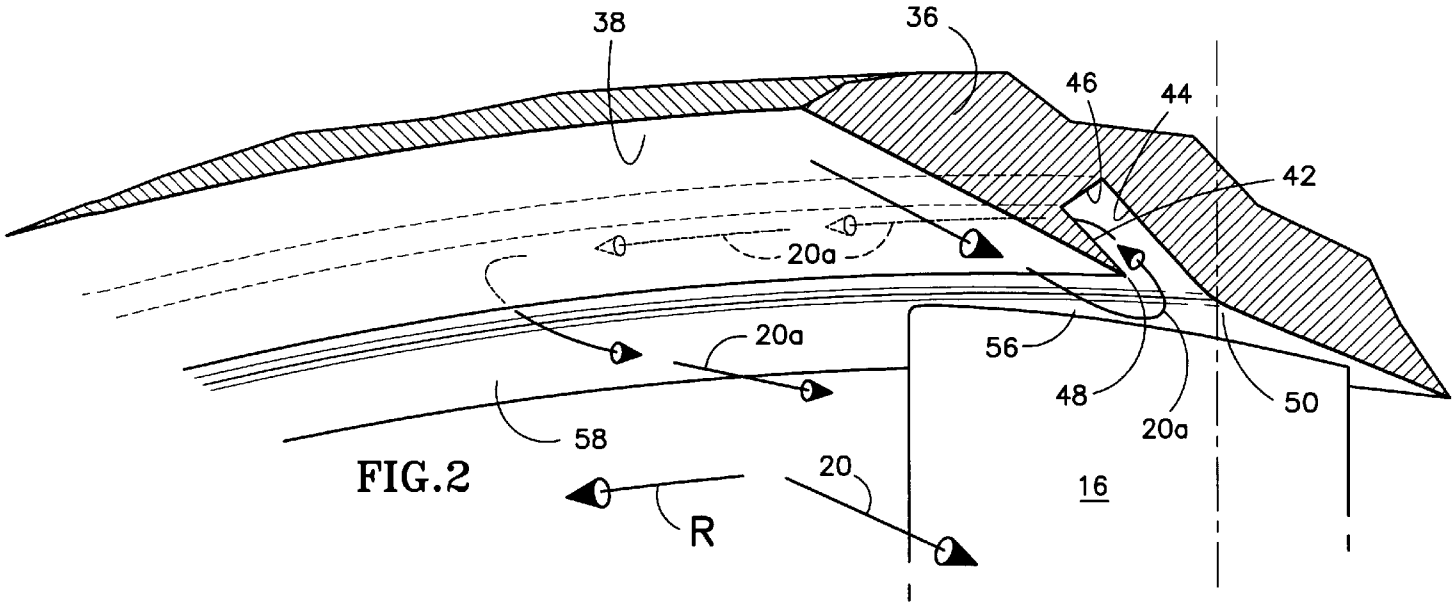
FIG. 2 is a schematic, perspective view typical of an axial flow compressor or fan for a turbine engine and showing a grooved casing according to one aspect of the present invention.

FIG. 2 depicts the fluid flow patterns attributable to the grooved casing treatment. The blade array represented by the single blade 16 rotates in direction R to pressurize the fluid stream 20, compelling the fluid to flow through the flowpath against an adverse pressure gradient. If the pressure loading of the blade tip region is excessive, the groove 40 provides a path for indigenous fluid to migrate circumferentially from the region of high loading (and correspondingly high pressure and low streamwise momentum) to another region where the local loading is more moderate, the flowpath pressure is less severe and the streamwise momentum of the fluid is greater. As used herein, the term "indigenous fluid" refers to fluid in the groove and in the flowpath in the vicinity of the groove as opposed to fluid supplied from a remote portion of the flowpath or from an external source. More specifically, fluid exits the flowpath and flows into the groove at an extraction site 56, proceeds circumferentially as shown by the fluid flow arrows 20*a*, and discharges into the flowpath at an injection site 58 substantially axially aligned with and circumferentially offset from the extraction site 56. The fluid flows as indicated by arrows 20*a* because the pressure of the fluid in the flowpath is higher at the extraction site than it is at the injection site. In particular, the flowpath fluid pressure at the injection site is lower than the flowpath fluid pressure adjacent the pressure surface of the blade at the extraction site. The migrated fluid is thus better positioned to advance against the flowpath adverse pressure gradient. The circumferential fluid migration also relieves the excessive blade tip loading at the extraction site and reduces the likelihood of tip vortex induced compressor stall or surge.

The groove walls are inclined at angles $\theta_A$ and $\theta_O$, so that fluid entering the flowpath at the injection site does so with an appreciable streamwise directional component. As a result, the high mixing losses that can arise from transverse fluid injection are at least partially avoided. In addition, the groove inclination and the accompanying streamwise directional component of fluid discharge help overcome any tendency of the fluid to recirculate unbeneficially into and out of the groove. Thus, the inventive casing treatment offers a stability improvement without exacting a significant penalty in compressor efficiency.

FIGS. 2A and 2B illustrate that the axial distribution of fluid flow into the groove at the extraction site 56 (FIG. 2A) may differ from the distribution of fluid flow out of the groove at the injection site 58 (FIG. 2B). At the extraction site 56, flowpath fluid pressure increases from $P_{1E}$ near the groove upstream wall 42 to $P_{2E}$ near the groove downstream wall 44. Since fluid flow into the groove is dominated by higher flowpath pressure, the mass flow rate of fluid entering the groove is distributed preferentially toward the downstream wall 44 as suggested by the schematic flow distribution diagram superimposed at the mouth 54 of the groove on FIG. 2A. At the injection site 58, flowpath fluid pressure increases from $P_{1I}$ near the upstream wall to $P_{2I}$ near the downstream wall. The lower pressure $P_{2I}$ dominates fluid discharge at the injection site by offering less resistance than the higher pressure $P_{2I}$. Accordingly, fluid discharge into the flowpath is distributed preferentially toward the upstream wall 42 as indicated by the flow distribution diagram of FIG. 2B. It should be appreciated that the distribution diagrams of FIGS. 2A and 2B are schematic. The actual fluid flow distributions are influenced by the local streamwise pressure gradients at the extraction and injection sites and by the magnitude of the circumferential pressure gradient in the flowpath. Moreover, it should be appreciated that the actual fluid dynamics are extremely complex, and that the distribution diagrams indicate the predominant fluid flow patterns. In practice some amount of fluid may discharge from the groove at the extraction site and may enter the groove at the injection site.

The positioning and length of the groove mouth, the groove orientation and the groove depth will vary depending on the operating characteristics and physical constraints of the compressor. Nevertheless certain general observations can be made.

Referring primarily to FIG. 1, the groove mouth 54 should be situated so that its downstream lip 50 is no further upstream than the leading edge 26 of the blade array at the blade tips. Such placement positions the groove to receive flowpath fluid that leaks over the blade tips and threatens to develop into a potentially destabilizing tip vortex. Since tip leakage vortices extend downstream of the blade tailing edges, the mouth may be situated so that its upstream lip 48 is downstream of the trailing edge 28 of the blade array at the blade tips. However it is anticipated that the groove will be most effective if its upstream lip 48 is no further downstream than the trailing edge 28 of the blade array at the blade tips. Thus, it is expected that the best benefits will be achieved if the groove mouth is positioned so that at least a portion of the mouth is streamwisely coextensive with the projected tip chord $C_P$, i.e. with the groove downstream lip 50 no further upstream than the leading edge 26 of the blade array at the blade tips and the upstream lip 48 no further downstream than the trailing edge 28 of the blade array at the blade tips.

The axial length L of the groove mouth 54 should be long enough to ensure that the mouth can capture a quantity of flowpath fluid sufficient to alleviate excessive blade loading. However since the mouth represents a discontinuity in the flowpath surface 38, the mouth length should be small enough to preclude fluid separation from the flowpath surface and concomitant fluid dynamic losses.

The groove orientation depends on both fluid dynamic and manufacturing considerations. As noted above, fluid discharge into the flowpath is distributed preferentially toward the upstream wall 42. Accordingly, the upstream wall strongly influences the direction of fluid discharge. Since it is desirable to accentuate the streamwise directional component of fluid discharge, the acute angle $\theta_A$ should be made as small as practicable. Manufacture of a case with a small acute angle $\theta_A$, nonparallel walls 42, 44, or other complex geometry may be facilitated by constructing the case of forward and aft portions that are mated together at an interface 59. If desired, the groove may instead be machined into a single piece case, however it has proved difficult to machine a groove having an acute angle $\theta_A$ of less than about 30°. If the groove is machined into a single piece case, it is desirable to facilitate manufacture by making the upstream and downstream walls 42, 44 parallel to each other so that the groove has a uniform axial width W.

The groove depth D is a compromise between fluid dynamic considerations, case structural integrity, space constraints and producibility. The groove must be shallow enough that the structural integrity of the casing is not compromised. However, if the groove is too shallow, the performance of the casing approaches that of a smoothwall case—one that preserves compressor efficiency but fails to improve the compressor's tolerance to tip vortices. By contrast, a deep groove has a greater capacity to carry fluid from the extraction site to the injection site, and therefore has a more beneficial effect on compressor stability. However it is believed that the stability benefit does not accrue without limit. Moreover, the groove depth is obviously limited by the thickness of the casing and any other radial space constraints. Experience with currently available machining techniques has demonstrated that it is possible to produce a groove whose depth D is at least about three times the mouth length L.

In one specific arrangement contemplated for a turbine engine being developed by the assignee of the present invention, the grooved casing treatment is applied to four of five compression stages in one of the engine's two core compressors. Each of the four blade arrays is circumscribed by a circumferentially extending groove whose upstream lip is situated at about 25% of the projected tip chord and whose downstream lip is situated at about 55% of the projected tip chord. The groove has parallel upstream and downstream walls and the upstream wall is oriented at an acute angle $\theta_A$ of about 30°. The groove depth is about two times the mouth length.

In view of the foregoing discussion, certain additional details of the grooved casing treatment can now be appreciated. As already noted, the orientation of the upstream wall 42 is thought to be more critical than the orientation of the downstream wall 44 in imparting a streamwise directional component to the discharged fluid. Therefore, it may be desirable to construct the casing, or at least the portion of the casing near the upstream lip 48, of a material capable of resisting erosion and abrasion. Otherwise the upstream lip may be chipped or worn away by foreign objects entrained in the fluid stream 20 or, more likely, by occasional contact with the blade tips during compressor operation. Either way, erosion of the lip 48 can allow fluid to enter the flowpath with a substantially diminished streamwise directional component, sacrificing much of the benefit of the invention.

The downstream lip 50 also influences fluid discharge into the flowpath. Ideally, the lip 50 is a smooth curve rather than a sharp corner defined by the prolongations of the flowpath surface 38 and the downstream wall 44. The curvature exploits the Coanda effect in which fluid immediately adjacent to a curved surface depressurizes and accelerates as it flows over the surface. Nearby higher pressure fluid not subject to the Coanda effect urges the affected fluid to follow the surface contour. As seen best in FIG. 1, the lip 50 is gently curved to take advantage of the Coanda effect and urge fluid discharging from the groove to hug the lip and turn in the streamwise direction.

It has also been determined that the stability enhancing effect of the casing treatment might be augmented by groove walls that exhibit a surface roughness that exceeds about 75 AA microinches. The AA surface roughness measure, also known as the roughness average (Ra) or centerline average (CLA), is defined in ANSI specification B46.1-1995 available from the American Society of Mechanical Engineers. The observation that surface roughness may be influential was made in the course of testing a turbine engine with a groove 40 machined into the fan casing 36 radially outboard of a single array of fan blades. In one test configuration the portion of the casing outboard of the fan blades was made of an abradable material (adhesive EC-3524B/A available from the 3M Company, St. Paul Minn., USA). Because of roughness inherent in the abradable material, the machined groove had a perceptible but indeterminate surface roughness. In a second configuration, the groove was machined into an aluminum case, resulting in relatively smooth walls having a surface roughness of only about 75 AA microinches in the axial direction and no more than about 16 AA microinches in the circumferential direction. During testing, the first configuration demonstrated better fan stability than the second configuration, suggesting that the surface roughness may be beneficial. A third configuration was tested to verify the benefit. The third configuration was a modified version of the second configuration in which ordinary paint was sprayed onto the groove walls. The spray gun used to apply the paint was positioned far enough away from the walls that the spray droplets partially congealed prior to contacting the walls. Upon striking the walls, the partially congealed droplets adhered to the wall surfaces to give the walls a granular texture whose roughness was determined to be about 300–400 AA microinches. Testing of the third configuration revealed fan stability similar to that of the first configuration, tending to confirm the desirability of surface texture. In practice, it will be necessary to use a more suitable, controllable and repeatable means of introducing a durable surface texture.

Figure 3:
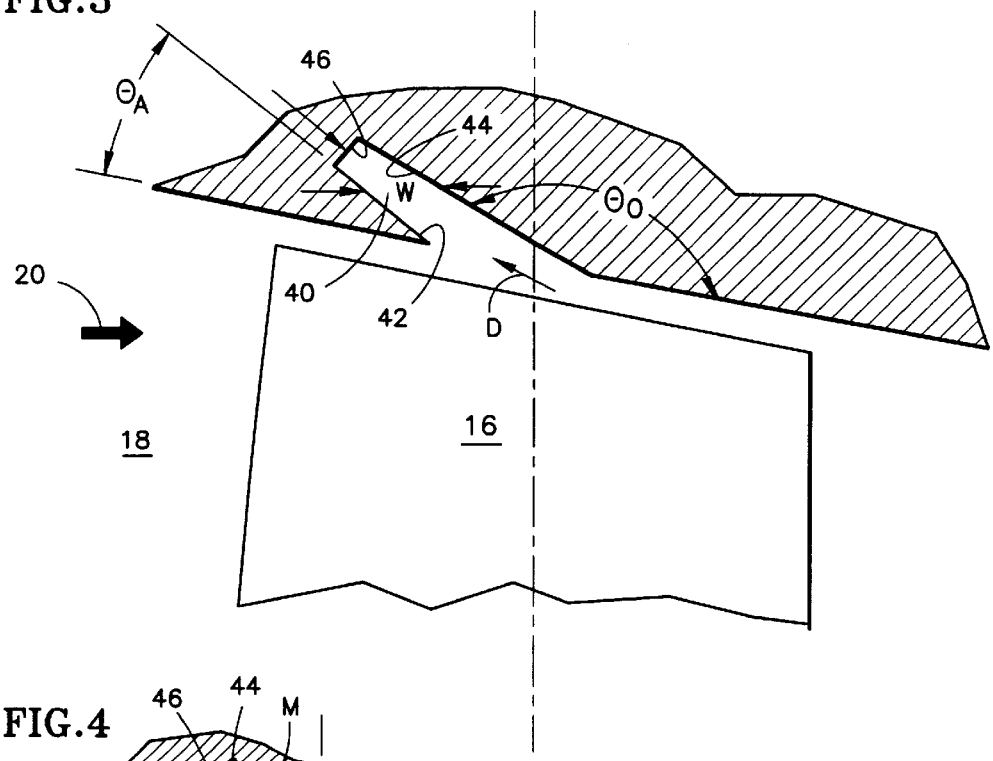
FIGS. 3–5 are views similar to FIG. 1 illustrating alternative embodiments of the grooved casing.
Figure 4:
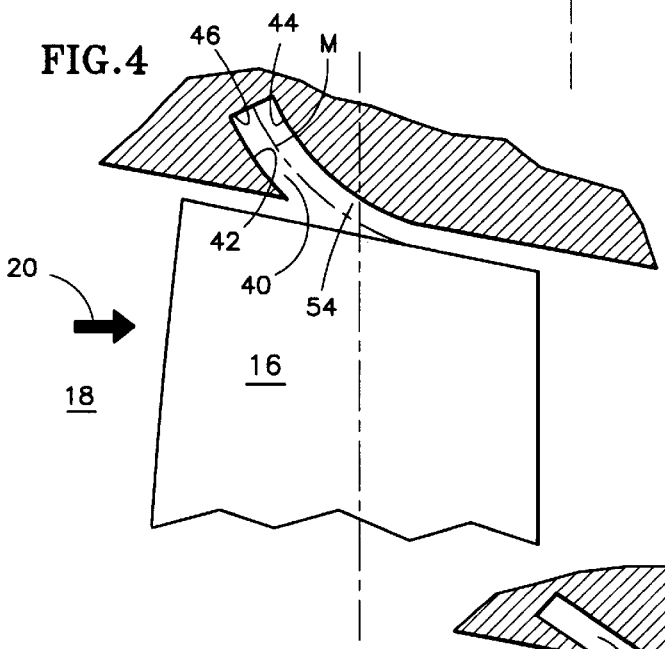
Figure 5:
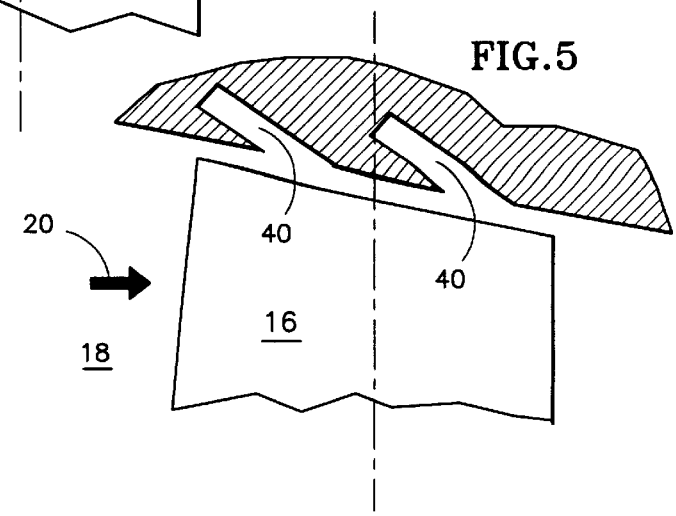

FIGS. 3, 4 and 5 depict alternative embodiments of the grooved casing treatment. In FIG. 3, the wall orientation angles $\theta_A$, $\theta_O$, are selected so that the upstream and downstream walls 42, 44 of the groove 40 define a tapered groove whose width W diminishes with increasing groove depth D. The diminishing width of the tapered groove slightly compresses fluid that flows into the groove at the extraction site so that the fluid will be more forcibly expelled into the flowpath at the injection site, thereby enhancing the benefit of the streamwise directional component.

FIG. 4 shows a grooved casing treatment in which the upstream and downstream walls 42, 44 define a contoured groove 40 for imparting a streamwise directional component to fluid entering the flowpath at the injection site. The contour is such that the slope of groove mean line M (a line midway between the upstream and downstream walls as measured perpendicular to the mean line) approaches an orientation more perpendicular than parallel to the streamwise direction near the groove floor 46 and more parallel than perpendicular to the streamwise direction near the groove mouth 54.

FIG. 5 shows a casing treatment comprising multiple grooves 40. Each groove is similar to the groove depicted in FIGS. 1, 2, 2A and 2B, however in practice each groove may have its own unique geometry (depth, width and orientation). Multiple grooves, whether of similar or dissimilar geometry, may be useful for selectively relieving excessive blade loading at multiple, axially distinct locations.

Figure 6:
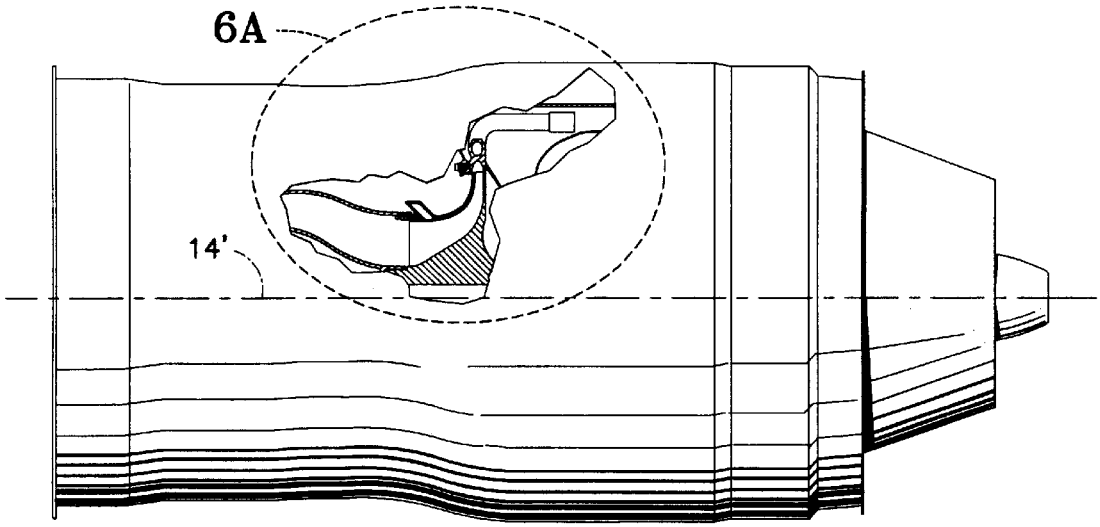
FIGS. 6 and 6A are schematic side views of a turbine engine with the engine casing partially broken away to expose a centrifugal compressor employing the grooved casing of the present invention.
Figure 6A:
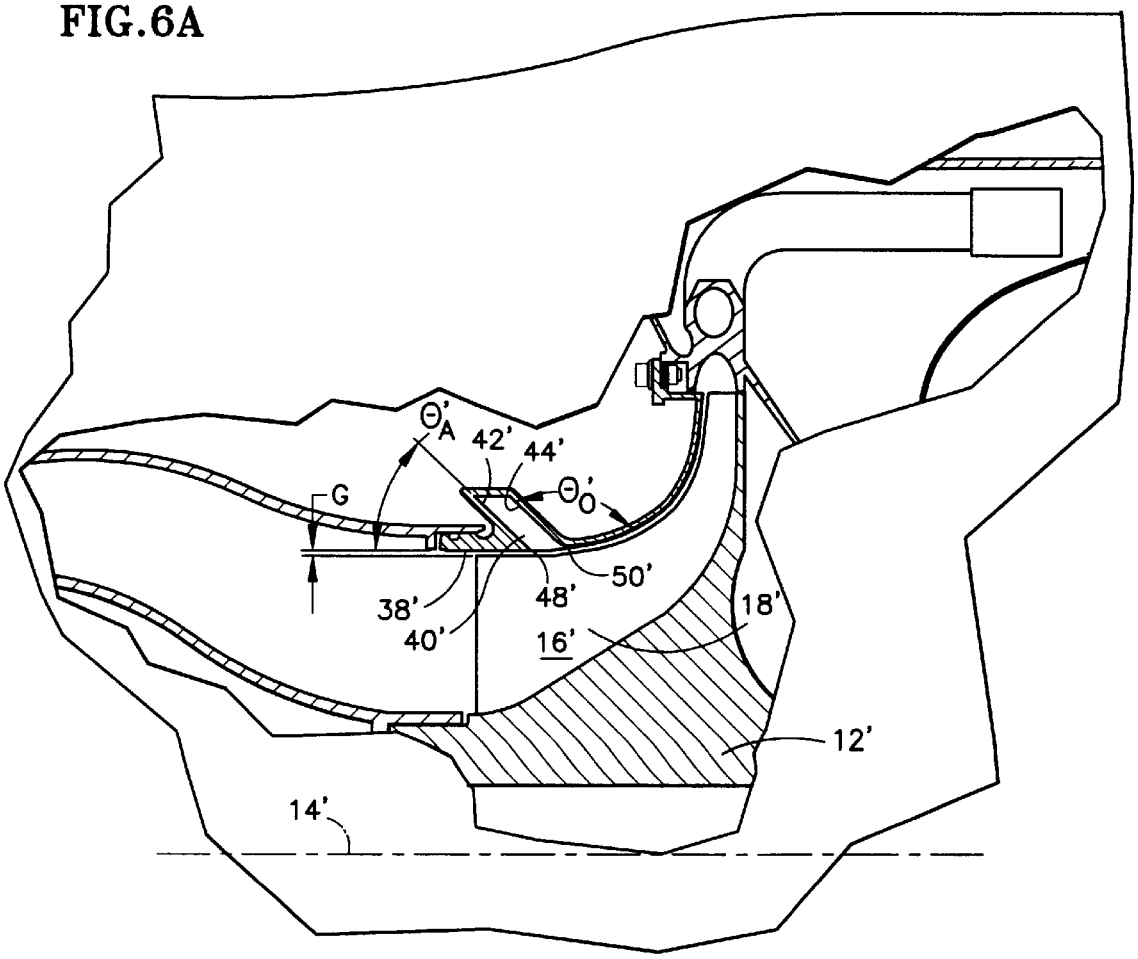

FIGS. 6 and 6A illustrate the grooved casing treatment as it might be applied to a centrifugal compressor in a turbine engine. Primed reference characters are used to designate features of the centrifugal compressor analogous to those already described for an axial flow compressor. In the centrifugal compressor at least a portion of the compressor flowpath 18' extends radially, i.e. approximately perpendicular, relative to the compressor rotational axis 14'. However the grooved casing treatment is similar in all respects to the grooved casing treatment for an axial flow compressor.

An aircraft turbine engine with a casing treatment similar to that illustrated in FIG. 1 has been tested by the assignee of the present application. The casing treatment groove 40 in the tested engine was situated outboard of an array of fan blades 16 with the groove upstream lip 48 at about 50% of the projected tip chord, and the groove downstream lip 50 at about 90% of the projected tip chord. The upstream and downstream walls 42, 44 were parallel to each other, the acute orientation angle $\theta_A$ was about 30° and the obtuse, angle $\theta_O$ was about 150°. The groove depth was about three times the groove width. For comparison, tests were also conducted with a smoothwall case (one not having a casing treatment) and with a conventional casing treatment comprising an array of six transverse grooves (i.e. $\theta_A$ and $\theta_O$ both equal to 90°) that allow fluid to enter the flowpath without any appreciable streamwise directional component. The tests were repeated with different clearance gaps G separating the blade tips 16 from the flowpath surface 38, the smallest or tightest of those clearances being representative of the clearance in a revenue service engine operating at its steady state design point. Testing at the larger clearances is significant because the blade tip clearance gap is usually at least slightly enlarged for brief time intervals during normal engine operation. Unfortunately, these enlarged clearances, which are detrimental to fluid dynamic stability, often occur in an aircraft engine at engine power levels and operating conditions where the fan is simultaneously exposed to other stability threats.

Figure 7A:
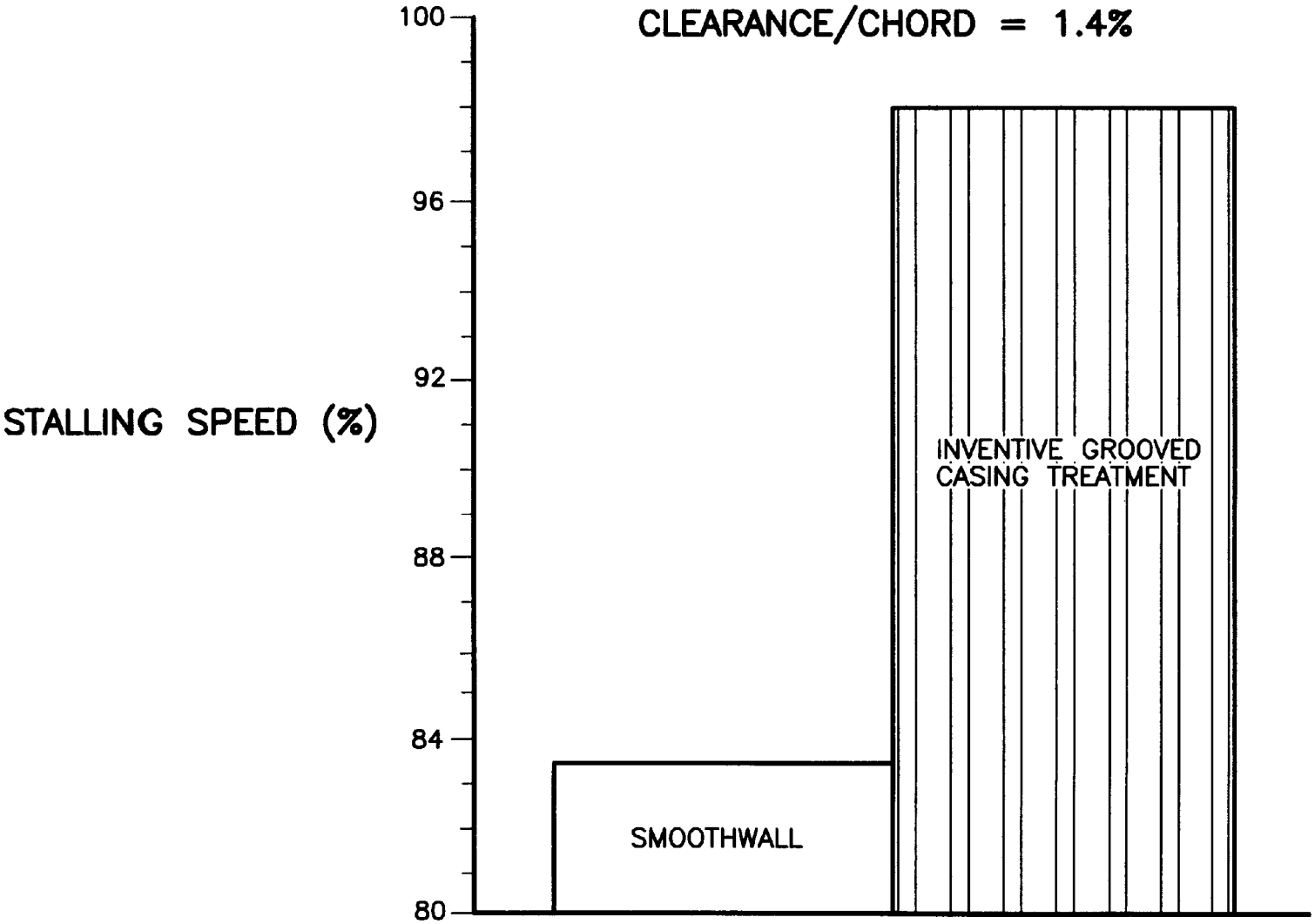
FIGS. 7A and 7B are graphs showing the influence of the grooved casing on compressor stability and efficiency respectively.
Figure 7B:
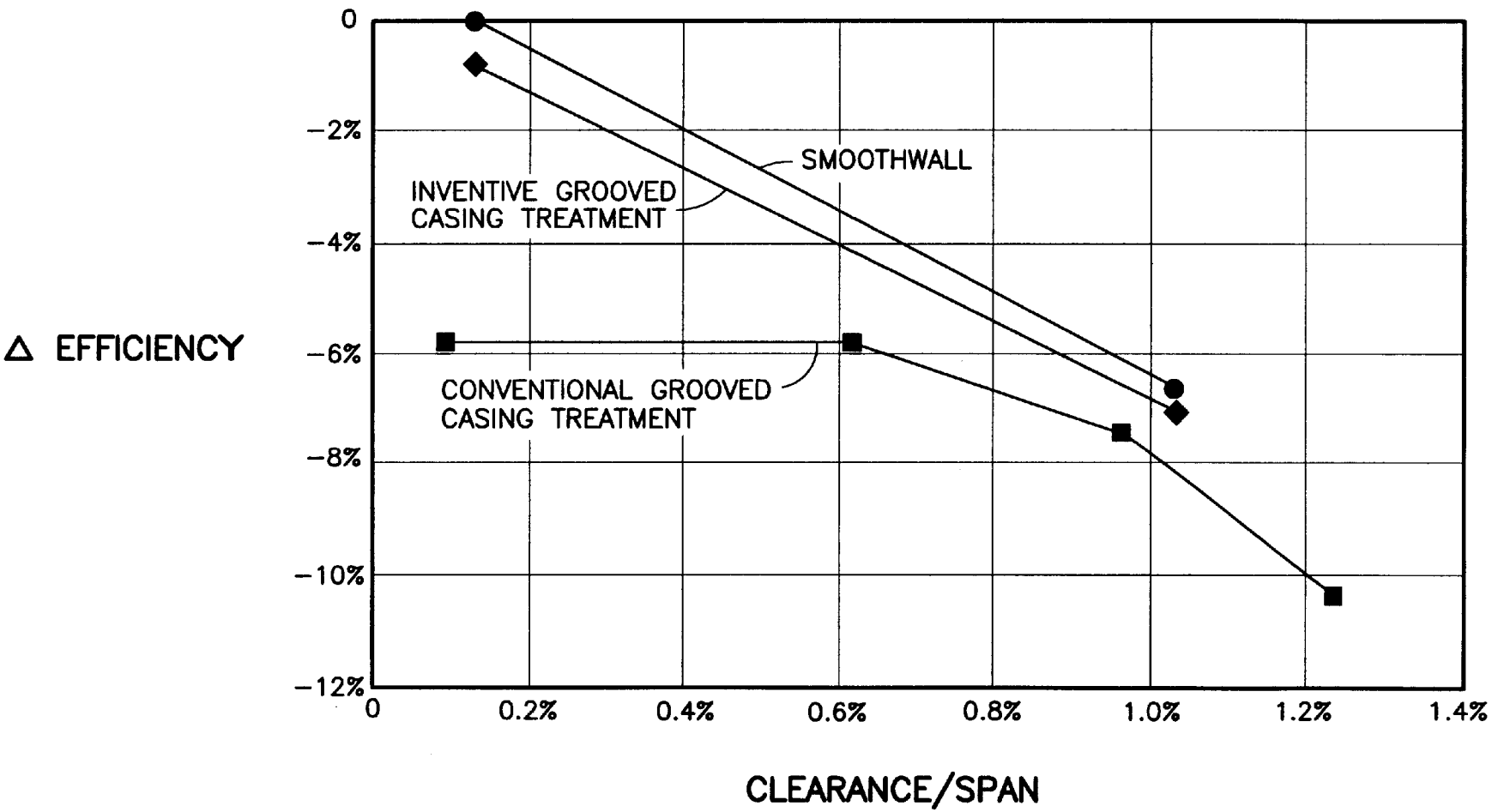

Results of the engine testing are displayed in FIGS. 7A and 7B. FIG. 7A shows the results of tests with a moderately enlarged tip clearance of about 1.4% of blade chord C. During the testing, engine power was gradually increased until the fan surged. Fan stability is represented on the Figure as the percent of compressor rotational speed at which stall occurred (100% speed is the mechanical redline speed). As seen in FIG. 7A, fan stability was significantly better with the inventive grooved casing than with a smoothwall case despite the somewhat enlarged tip clearance.

FIG. 7B shows how steady state fan efficiency is affected by the casing treatments. Tip clearance is expressed in the Figure as a percentage of blade span S as seen in FIG. 1). The graph reveals that the efficiency penalty attributable to the inventive grooved casing treatment is appreciably less than that attributable to the conventional grooved treatment, especially at the tightest tip clearance. The less dramatic benefit at the enlarged clearances is not troublesome since a turbine engine fan or compressor normally operates with loose clearances for only brief periods of time. When the engine is operated at its design condition, the clearances are tight.

In combination, FIGS. 7A and 7B demonstrate that the inventive grooved casing treatment offers a significant improvement in stability with only a modest penalty to compressor efficiency.

Figure 8:
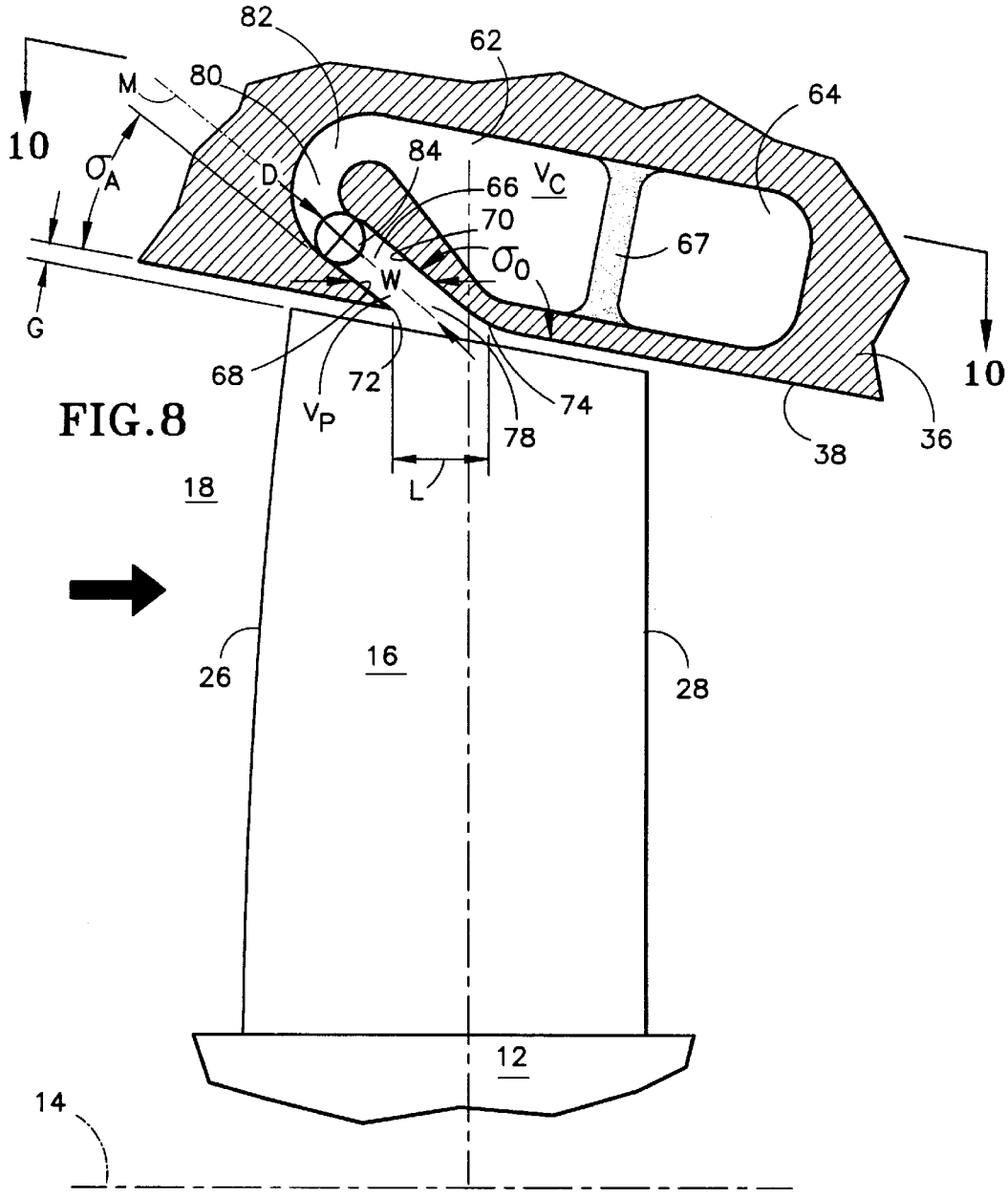
FIG. 8 is a schematic, cross sectional side view typical of an axial flow compressor or fan for a turbine engine showing a casing with a pressure compensation chamber according to a second aspect of the present invention.

FIG. 8 illustrates an axial flow compressor similar to that of FIG. 1 but with a casing treatment according to the second, pressure compensating aspect of the invention. The compressor casing 36 includes a circumferentially continuous compartment 62 comprising a voluminous pressure compensation chamber 64 and a single passage 66 circumferentially coextensive with the chamber. Optional, circumferentially distributed support struts 67 lend structural support to the chamber. The passage 66 is defined at least in part by spaced apart upstream and downstream walls 68, 70. Each wall extends to and adjoins the casing flowpath surface 38 at respective upstream and downstream lips 72, 74. The lips define a passage mouth 78 that places the passage in fluid communication with the flowpath 18. A slot 80 at the other end of the passage connects the passage to a circumferentially continuous elbow 82 leading to the chamber so that the chamber is in fluid communication exclusively with the flowpath. An optional valve 84 may be installed in the passage or elbow.

The pressure compensating variant of the invention shown in FIG. 8 is believed to improve compressor stability primarily by relying on the volume of the compartment 62 to attenuate the inordinate circumferential pressure difference across the tip (i.e. between the pressure surface and the suction surface) of an excessively loaded blade. Circumferential migration of indigenous fluid, which is believed to be the primary operational mechanism of the grooved version of the casing treatment (FIGS. 1, 2A, 2B and 3–6), is thought to be of lesser importance in the pressure compensating variant of the invention. Accordingly, the compartment volume, i.e. the combined volume $V_C$ of the chamber 64 and $V_P$ of the passage 66, is sufficiently large to attenuate pressure differences across the blade tips and to keep fluid pressure within the compartment approximately circumferentially uniform during normal operation of the compressor. As a result, the compartment attenuates excessive circumferential pressure differences that may develop across a blade tip and therefore impedes development of tip leakage vortices strong enough to destabilize the compressor.

In practice, the chamber volume $V_C$ should be at least as large as the passage volume $V_P$. Otherwise the performance of the pressure compensating variant of the treatment approaches that of the grooved variant. It is also believed that in most practical implementations of the invention, a chamber volume more than a factor of ten larger than the passage volume will not appreciably improve the performance of the invention.

Figure 10:
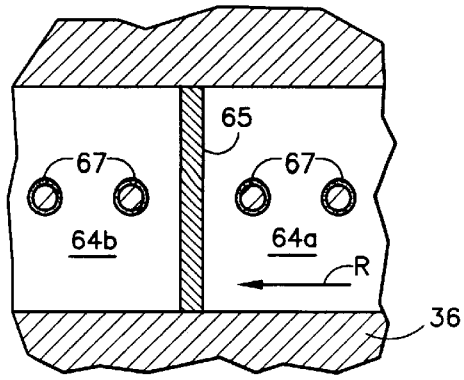
FIG. 10 is a fragmentary developed view taken in the direction 10—10 of FIG. 8 showing the pressure compensating variant of the invention and one of two diametrically opposed optional partitions segregating the pressure compensation chamber into two subchambers.

Although the pressure compensation chamber and passage are preferably circumferentially continuous, it may be acceptable to segment the pressure compensation chamber into two or more subchambers. FIG. 10 illustrates an arrangement in which two subchambers 64*a*, 64*b* are defined by a pair of diametrically opposed partitions such as partition 65. Such an arrangement might be necessary to provide structural support across the entire axial length of the chamber. However the subchambers are each less voluminous than a single, circumferentially continuous chamber and therefore are less able to attenuate excessive pressure differences across the blade tips. Moreover, the fluid medium may communicate undesirable dynamic interactions between the partitions and the blades as the blades move in direction R during compressor operation. To minimize the likelihood of such interactions it is recommended that the subchambers, if employed at all, be limited in number to no more than about one factor of ten less than the quantity of blades in the blade array. For example, no more than 2 subchambers are recommended for an array of 22 blades.

Although the pressure compensating variant of the invention does not rely primarily on circumferential migration of indigenous fluid, some fluid will nevertheless flow into and out of the passage. Therefore, the illustrated embodiment of the pressure compensating treatment includes a passage oriented similarly to the groove of the grooved treatment so that fluid flowing from the passage enters the flowpath with a streamwise directional component. Specifically, the upstream wall 68 is oriented at an acute angle $\sigma_A$ relative to the flowpath surface 38 and the downstream wall 70 is oriented at an obtuse angle $\sigma_O$ relative to the flowpath surface 38. The actual passage orientation depends on both fluid dynamic and manufacturing considerations. The acute angle should be as small as possible since it is desirable to accentuate the streamwise directional component of fluid discharge and since, as noted in the discussion of the grooved variant of the casing treatment, the upstream wall 68 has a strong influence on the direction of fluid discharge. Thus, as also noted previously in connection with the grooved variant, it may be desirable to construct the case of forward and aft portions to facilitate fabrication of a passage having a small acute angle $\sigma_A$, nonparallel walls (if desired) or other complex geometry. Alternatively the passage may be machined into a single piece case, however it has proven difficult to machine a groove having an acute angle $\sigma_A$ of less than about 30°. If the groove is machined into a single piece case, it is desirable to facilitate manufacture by making the upstream and downstream walls 68, 70 parallel to each other, resulting in a passage of uniform axial width W.

The passage mouth 78 should be situated so that its downstream lip 74 is no further upstream than the leading edge 26 of the blade array at the blade tips. Such positioning ensures that the compartment 62 will respond to the fluid dynamic loading and vortex inducing fluid leakage at the blade tips. Since the tip leakage vortices extend downstream of the blade trailing edges, the mouth may be situated so that its upstream lip 72 is downstream of the trailing edge 28 of the blade array at the blade tips. However it is anticipated that the treatment will be most effective if the upstream lip 72 is no further downstream than the trailing edge 28 of the blade array at the blade tips. Thus, it is expected that the best benefits will be achieved if the passage mouth is positioned so that at least a portion of the mouth is streamwisely coextensive with the projected tip chord $C_P$, i.e. with the passage downstream lip 74 no further upstream than the leading edge 26 of the blade array at the blade tips and the upstream lip 72 no further downstream than the trailing edge 28 of the blade array at the blade tips.

The axial length L of the passage mouth 78 should be long enough to ensure that the compartment 64 is reliably coupled to the flowpath so that the compartment can function as intended. However since the mouth represents a discontinuity in the flowpath surface 38, the mouth length should be small enough to minimize the likelihood that its presence might introduce fluid dynamic losses by provoking fluid separation from the flowpath surface 38. A mouth axial length of between about 2% and 25% of the length of the projected tip chord $C_P$ is thought to represent a reasonable balance between these considerations.

It is thought that the axial length of passage mouth 78 can be made smaller than the axial length of the groove mouth 54 of the grooved variant of the casing treatment. The smaller mouth length is acceptable because the stability enhancing characteristics of the pressure compensating variant are thought to be predominantly attributable to the volume of compartment 62, a volume that is largely independent of the length of passage mouth 78. By contrast, any similar volumetric influence of the grooved casing treatment necessarily arises from the volume of the groove itself, a volume significantly affected by the length of the groove mouth 54.

The passage 66 may be shallow or may have a depth D sufficient to augment the chamber's ability to attenuate excessive pressure difference or loading across the blade tips. The pressure difference, which is communicated to fluid in the passage, is attenuated as an exponential function of the distance from the blade tip to any arbitrary point of interest inside the passage. Assuming subsonic fluid flow in the flowpath near the blade tips, fluid dynamic theory predicts that a passage whose depth D is approximately equal to about 70% of the blade pitch (the circumferential distance between the leading edges 26 of adjacent blade tips) can attenuate the pressure difference by about 50%. The actual amount of attenuation will vary depending on the operating characteristics of a given compressor. In practice, geometric or physical constraints of the engine may limit the passage depth to a value less than that necessary for achieving a desired degree of pressure attenuation. Nevertheless, the passage depth should be as large as is practical with a reasonable lower limit being about 10% of the blade pitch, which will yield about a 10% attenuation of the pressure difference.

The foregoing observations regarding chamber volume, passage volume, passage orientation, mouth positioning, mouth length and passage length are, like the corresponding observations regarding the groove of the grooved treatment, general in nature. The actual geometry of the pressure compensating variant of the invention will depend on the operating characteristics and physical constraints of the compressor of interest.

Notwithstanding the test results discussed in more detail below, the pressure compensating variant of the casing treatment may degrade compressor efficiency. Although the efficiency penalty is expected to be less than that associated with many conventional casing treatments, it may nevertheless be desirable to avoid the efficiency penalty when the compressor is not exposed to multiple stability threats and is unlikely to stall or surge due to excessive blade loading alone. When a compressor is used in an aircraft engine, the threat to compressor stability is minimal during the time intervals spent operating the engine at its cruise power setting. Because these time intervals are lengthy, they also represent a period of operation when the efficiency penalty is most objectionable. Accordingly, the casing treatment may include an optional valve 84. A control system, not shown, would command the valve to close when stability augmentation is unnecessary, effectively negating both the stability benefit and the efficiency penalty of the casing treatment.

Figure 9:
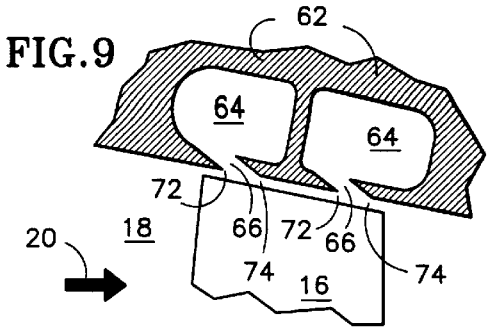
FIG. 9 is a view similar to FIG. 8 illustrating an alternative embodiment of the pressure compensating variant of the invention.

FIG. 9 illustrates another embodiment of the pressure compensating variant of the casing treatment. This embodiment features two compartments 62 each comprising a pressure compensation chamber 64 and a single passage 66 circumferentially coextensive with the chamber for establishing fluid communication with the compressor flowpath 18. As shown, the chambers and their associated passages are substantially identical to each other. In practice, each passage and chamber may have its own unique geometry. The multiple compartment configuration, whether of similar or dissimilar geometry, may be useful for selectively relieving excessive blade tip loading at multiple, axially distinct locations.

Figure 11:
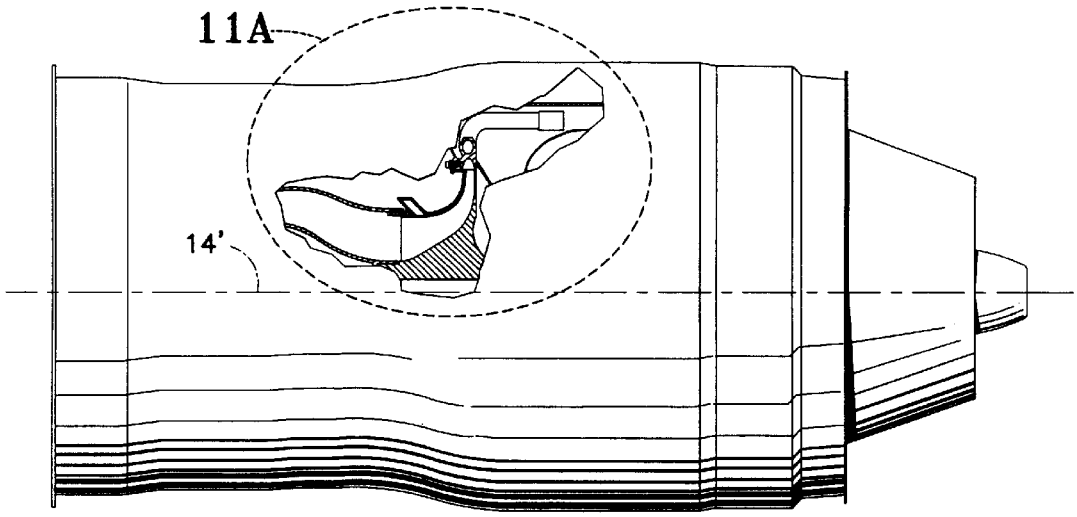
FIGS. 11 and 11A are schematic side views of a turbine engine with the engine casing partially broken away to expose a centrifugal compressor employing the pressure compensating variant of the present invention.
Figure 11A:
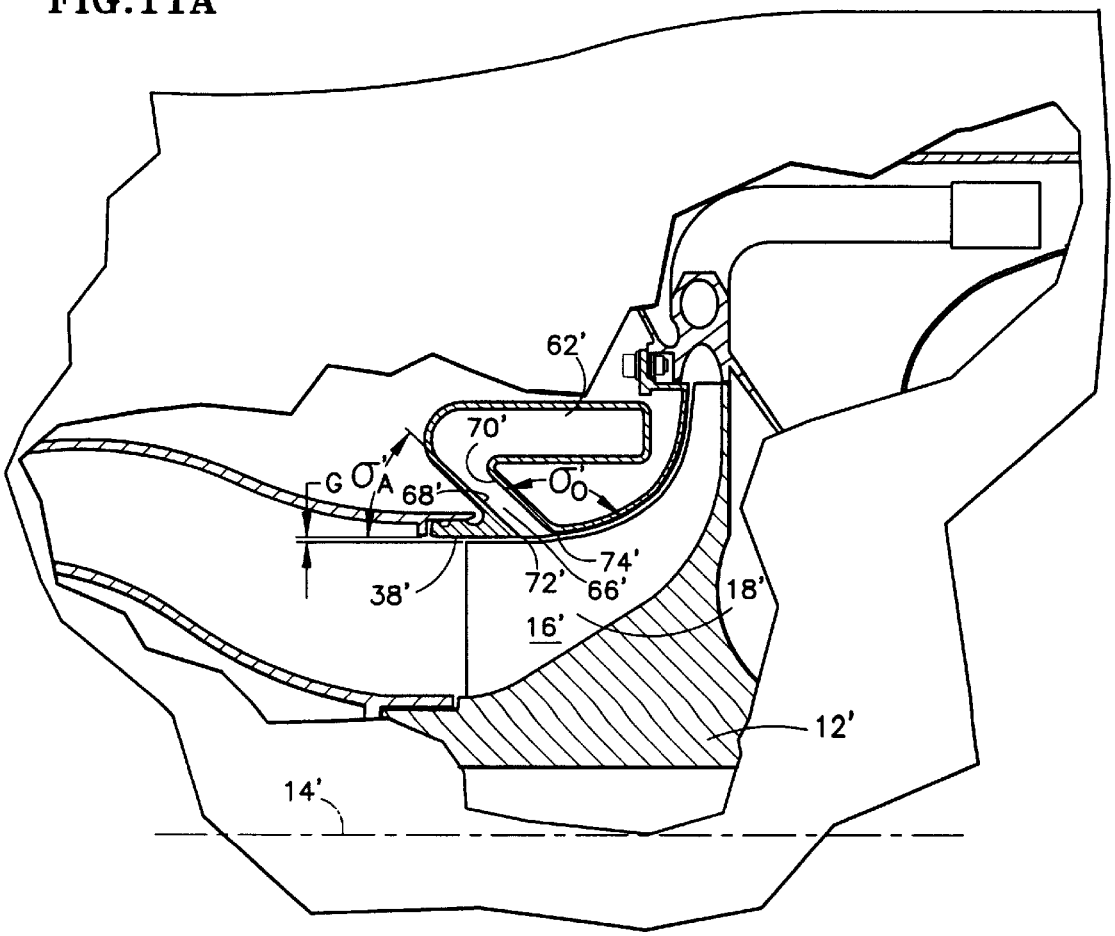

FIGS. 11 and 11A illustrate the pressure compensating casing treatment as it could be applied to a centrifugal compressor in a turbine engine. Primed reference characters are used to designate features of the centrifugal compressor analogous to those already described for an axial flow compressor. In the centrifugal compressor at least a portion of the compressor flowpath 18' extends radially, i.e. approximately perpendicular, relative to the compressor rotational axis 14'. However the pressure compensating casing treatment is similar in all respects to the pressure compensating casing treatment for an axial flow compressor.

The assignee of the present invention has conducted evaluation tests of the pressure compensating casing treatment using a seventeen inch diameter axial flow fan rig. The tested casing treatment was a dual-chambered version similar to that shown in FIG. 9. The casing treatment passages 66 of the tested rig were situated outboard of a single array of fan blades each having a chord of about 3.5 inches. The upstream and downstream lips 72, 74 of the forwardmost of the two passages 66 were at about 13.7% and 19.3% of the projected tip chord $C_P$ and the lips of the aft passage were at about 55.0% and 60.6% of $C_P$ (i.e. each passage mouth had a length of about 5.6% of $C_P$, which is about 0.123 inches. The upstream and downstream walls of each passage 68, 70 were parallel to each other, the acute orientation angles $\sigma_A$ were about 30° and the obtuse angles $\sigma_O$ were about 150°. The depth of each groove was about 2.5 times the groove width or about 0.3 inches. The volume $V_c$ of each chamber 64 was about ten times the volume $V_P$ of the corresponding passage 66. For comparison, tests were also conducted with a smoothwall case (one not having a casing treatment). The tests were repeated with clearance gaps G of about 1.4% and 4.2% of the chord length at the blade tips.

Figure 12A:
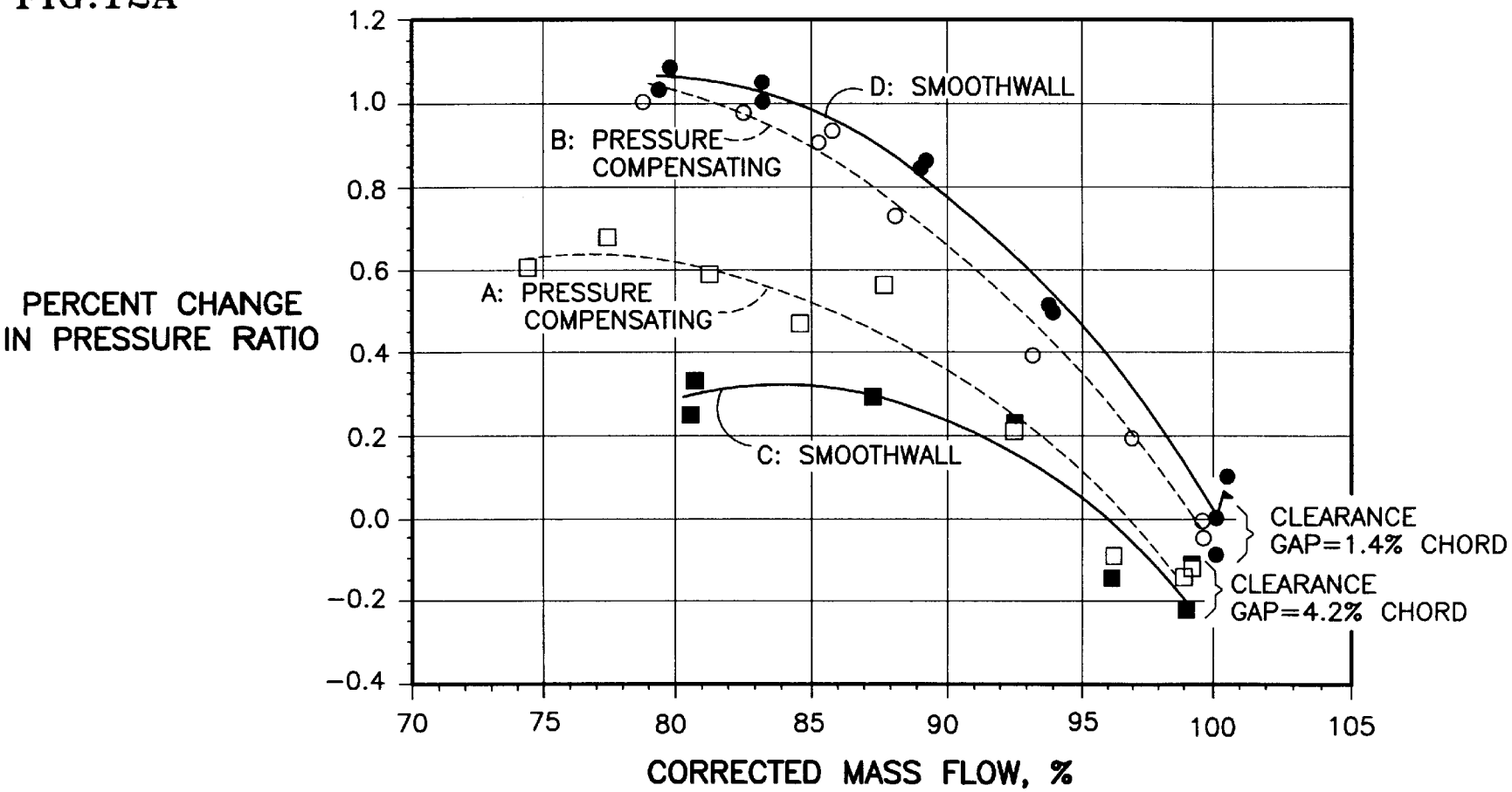
FIGS. 12A and 12B are graphs showing the influence of the pressure compensating variant of the invention on pressurization capability and compressor efficiency respectively.
Figure 12B:
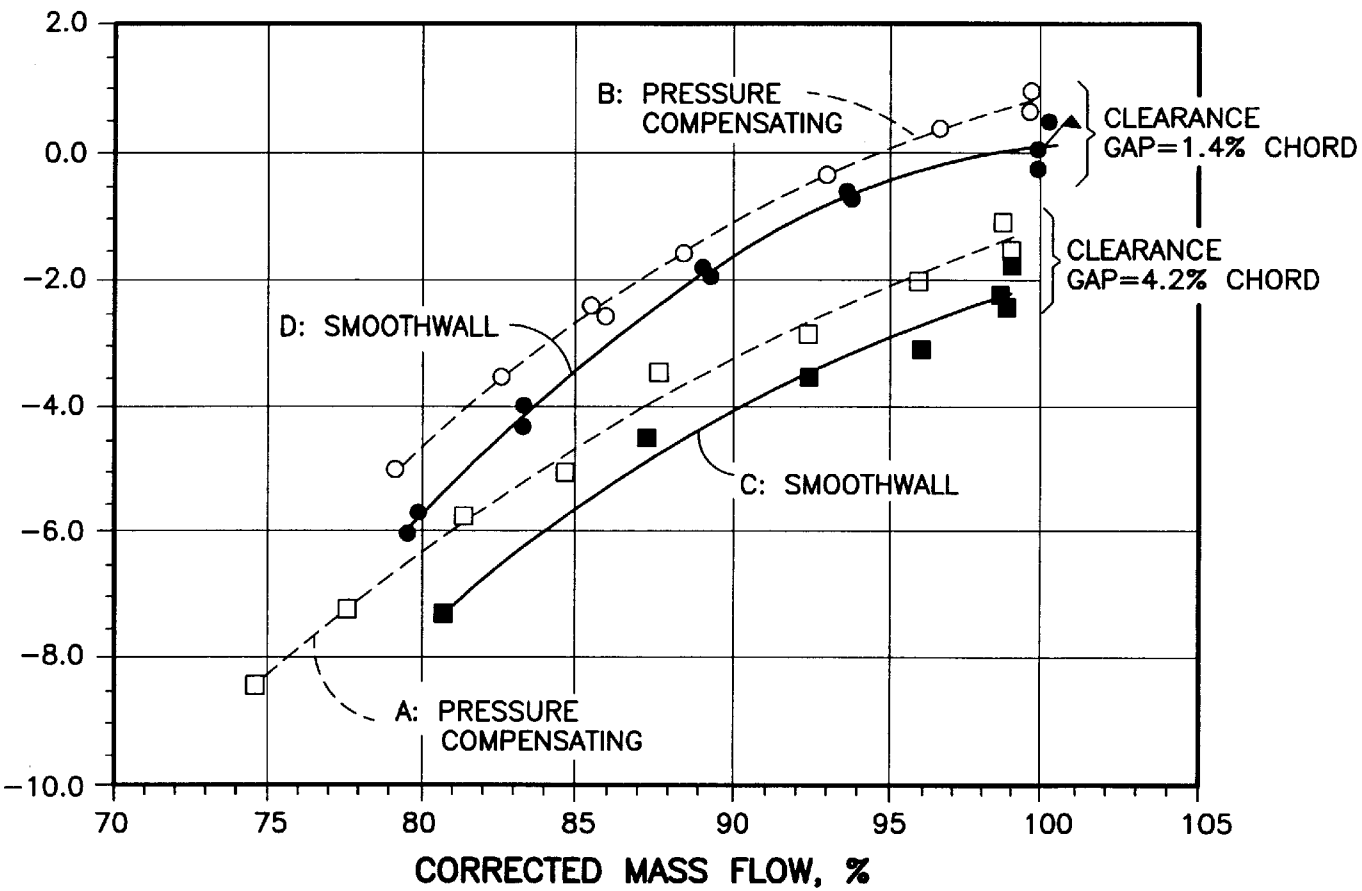

Results of the compressor testing are displayed in FIGS. 12A and 12B. FIG. 12A shows pressure rise capability and FIG. 12B shows efficiency, each as a function of corrected mass flow rate of fluid through the fan. The corrected mass flow is expressed as a percent of the mass flow at the flagged data point. Pressure rise and efficiency are expressed as a percentage difference relative to the flagged data point. The tests were run at a corrected rotational speed $N_{corr}$ of about 9500 rpm. Corrected mass flow rate and corrected speed are defined as:

$$W_{corrected} = \frac{W_{actual}(T/T_{std})^{1/2}}{P/P_{std}}$$

$$N_{corr} = \frac{N_{actual}}{(T/T_{std})^{1/2}}$$

where T and P are the absolute pressure and temperature at the fan inlet, and $T_{std}$ and $P_{std}$ are corresponding standard or reference values (518.7° R and 14.7 psia in English units).

As seen in FIG. 12A, when the fan was tested with the pressure compensating casing treatment, it exhibited less pressure rise capability with a loose clearance than it did with a tight clearance (curves A vs. B). However this loss of capability was smaller than the loss exhibited by the smoothwall casing (curves C vs. D). This observation suggests that the pressure compensating treatment is superior to the smoothwall case at inhibiting fluid leakage across the blade tips, and therefore contributes to improved compressor (fan) stability. FIG. 12B shows that fan efficiency was not adversely affected by the pressure compensating casing treatment at either of the tip clearances tested (curves B vs D for the tight clearance gap and curves A vs C for the loose clearance gap). On the contrary, the data shows an efficiency increase indicating that the pressure compensating casing treatment has merit as a performance enhancing feature in addition to its value as a stability enhancer. In combination, FIGS. 12A and 12B demonstrate that the pressure compensating casing treatment offers an improvement in stability with little or no penalty to compressor efficiency. Moreover, the efficiency data suggests that the casing treatment may have merit as a performance enhancer, even when stability augmentation is not needed.

Although the invention has been described with reference to exemplary embodiments thereof, those skilled in the art will appreciate that various changes and adaptations may be made without departing from the invention as set forth in the accompanying claims.

We claim:

1. A fluid compressor, comprising:

a blade array rotatable about a rotational axis, each blade of the array having a root, a tip, a leading edge, a trailing edge and a projected tip chord, each blade spanning a fluid flowpath that channels a stream of fluid through the compressor;

a casing having a flowpath surface circumscribing and spanwisely spaced from the blade tips, the casing having a circumferentially extending groove in fluid communication with the flowpath for receiving fluid from the flowpath at a fluid extraction site and for discharging fluid into the flowpath at a fluid injection site circumferentially offset from the extraction site;

the groove being defined at least in part by an upstream wall and a downstream wall, both walls extending to and adjoining the flowpath surface at respective upstream and downstream lips, the lips forming a mouth of the groove, the upstream wall being oriented at an acute angle relative to the adjoining flowpath surface, and the downstream wall being oriented at an obtuse angle relative to the adjoining flowpath surface so that the discharged fluid enters the flowpath with a streamwise directional component.

2. The fluid compressor of claim 1 wherein the acute and obtuse angles are selected so that the walls are parallel to each other and define a groove of uniform width.

3. The fluid compressor of claim 1 wherein the acute and obtuse angles are selected so that the walls define a tapered groove whose width diminishes with increasing groove depth.

4. The fluid compressor of claim 1 wherein the upstream and downstream walls define a contoured groove having a floor, a mouth and a mean line whose slope approaches an orientation more perpendicular than parallel to the streamwise direction near the groove floor and more parallel than perpendicular to the streamwise direction near the groove mouth for imparting a streamwise directional component to fluid entering the flowpath at the injection site.

5. The fluid compressor of claim 1 wherein the groove downstream lip is no further upstream than the leading edge of the blade array at the blade tips.

6. The fluid compressor of claim 5 wherein the groove upstream lip is no further downstream than the trailing edge of the blade array at the blade tips.

7. The fluid compressor of claim 1 wherein the mouth has a streamwise length and the groove has a depth of up to about three times the mouth length.

8. The fluid compressor of claim 1 wherein the downstream lip is curved to encourage fluid discharging from the groove to turn in the streamwise direction.

9. The fluid compressor of claim 1 wherein the flowpath extends substantially parallel to the rotational axis, the groove upstream lip is situated at about 25% of the projected tip chord, the groove downstream lip is situated at about 55% of the projected tip chord, the acute angle is approximately 30 degrees, the obtuse angle is approximately 150 degrees, the mouth has a streamwise length and the groove has a depth of approximately two times the mouth length.

10. The fluid compressor of claim 1 wherein at least a portion of the flowpath extends approximately normal to the rotational axis.

11. The fluid compressor of claim 1 wherein the groove walls have a surface roughness of at least about 75 AA microinches.

12. The fluid compressor of claim 11 wherein the surface roughness is between about 300 AA microinches and about 400 AA microinches.

13. A fluid compressor for a turbine engine, comprising:

a hub rotatable about a rotational axis;

a blade array extending outwardly from the hub, each blade of the array having a root, a tip, a leading edge a trailing edge, and a projected tip chord, each blade spanning a fluid flowpath that channels a stream of fluid through the compressor;

a casing having a flowpath surface circumscribing and spanwisely spaced from the blade tips, the casing having a circumferentially extending groove in fluid flow communication exclusively with the flowpath for receiving indigenous fluid from the flowpath at a fluid extraction site and for discharging indigenous fluid into the flowpath at a fluid injection site substantially streamwisely aligned with and circumferentially offset from the extraction site;

the groove comprising streamwisely spaced apart upstream and downstream walls each extending to and adjoining the flowpath surface to define respective upstream and downstream lips, the lips defining a mouth of the groove, the upstream wall being oriented at an acute angle relative to the adjoining flowpath surface, the downstream wall being oriented at an obtuse angle relative to the adjoining flowpath surface, the groove mouth being positioned so that at least a portion of the mouth is streamwisely coextensive with the projected tip chord.

14. A fluid compressor, comprising:

a blade array rotatable about a rotational axis, each blade of the array having a root, a tip, a leading edge and a trailing edge, and each blade spanning a fluid flowpath that channels a stream of fluid through the compressor; and a casing having a flowpath surface circumscribing and spanwisely spaced from the blade tips, the casing having a circumferentially extending groove in fluid flow communication with the flowpath for receiving fluid from the flowpath at a fluid extraction site and for discharging fluid into the flowpath at a fluid injection site so that the discharged fluid enters the flowpath with a streamwise directional component, the fluid injection site being circumferentially offset from the fluid extraction site.

15. A method of augmenting fluid flow stability of a compressor, the compressor having a blade array rotatable about an axis, each blade of the array extending across a flowpath that channels a stream of fluid through the compressor, each blade also having a blade tip, the compressor also having a casing with a flowpath surface spaced apart from and circumscribing the blade tips, the fluid stream having a circumferentially nonuniform, streamwisely adverse pressure gradient, the method comprising:

diverting indigenous fluid from the flowpath at an extraction site circumferentially aligned with a relatively high flowpath fluid pressure ;

directing the indigeneous fluid circumferentially to an injection site circumferentially aligned with a relatively low flowpath fluid pressure ; and discharging the indigenous fluid into the flowpath at the injection site so that the discharged fluid enters the flowpath with a streamwise directional component.

16. A method of augmenting fluid flow stability of a compressor, the compressor having a blade array rotatable about an axis, each blade of the array extending across a flowpath that channels a stream of fluid through the compressor, each blade also having a blade tip a pressure surface and a suction surface, the compressor also having a casing with a flowpath surface spaced apart from and circumscribing the blade tips, the fluid stream having a circumferentially nonuniform, streamwisely adverse pressure gradient, the method comprising:

diverting indigenous fluid from the flowpath at an extraction site circumferentially aligned with a relatively high circumferential pressure difference across a blade tip;

directing the indigeneous fluid circumferentially to an injection site circumferentially aligned with a flowpath fluid pressure lower than the flowpath fluid pressure adjacent the pressure surface of the blade at the extraction site; and discharging the indigenous fluid into the flowpath at the injection site so that the discharged fluid enters the flowpath with a streamwise directional component.

17. A fluid compressor, comprising:

a blade array rotatable about a rotational axis, each blade of the array having a root, a tip, a leading edge a trailing edge, a suction surface extending from the leading edge to the trailing edge, a pressure surface spaced from the suction surface and also extending from the leading edge to the trailing edge and a projected chord, each blade spanning a fluid flowpath that channels a stream of fluid through the compressor; and a casing having a flowpath surface circumscribing and spanwisely spaced from the blade tips, the casing including a compartment with a passage that extends to the flowpath at a location axially proximate the blade tips, the compartment comprising a circumferentially extending chamber and a single passage circumferentially coextensive with the chamber, the passage having a slot connecting the passage to the chamber and a mouth connecting the passage to the flowpath, the passage being defined at least in part by an upstream wall and a downstream wall each having a surface roughness of at least about 75 AA microinches, both walls extending to and adjoining the flowpath surface at respective upstream and downstream lips bordering the passage mouth, the compartment having a volume sufficiently large to attenuate circumferential pressure differences across the blade tip and to keep fluid pressure within the compartment approximately circumferentially uniform during normal operation of the compressor thereby attenuating circumferential variation in flowpath pressure and resisting vorticity induced fluid dynamic instabilities.

18. The fluid compressor of claim 17 wherein the surface roughness is between about 300 AA microinches and about 400 AA microinches.

* * * * *

UNITED STATES PATENT AND TRADEMARK OFFICE

CERTIFICATE OF CORRECTION

PATENT NO. : 6,231,301 B1
DATED : May 15, 2001
INVENTOR(S) : Martin Graf, John A. Raw It is certified that error appears in the above-identified patent and that said Letters Patent is hereby corrected as shown below:

Title page,
Delete the names of the following individuals presently listed as inventors:
Mark Barnett
Om Sharma
William D. Sprout Signed and Sealed this Twelfth Day of March, 2002

*Attest:*

*Attesting Officer*

JAMES E. ROGAN
*Director of the United States Patent and Trademark Office*